US011634945B2

(12) United States Patent
Taubenrauch et al.

(10) Patent No.: US 11,634,945 B2
(45) Date of Patent: Apr. 25, 2023

(54) ROLLER BLIND, PROCESS FOR MANUFACTURING SAME AND ROLLER BLIND SYSTEM WITH SUCH A ROLLER BLIND

(71) Applicant: Hunter Douglas Industries Switzerland GmbH, Lucerne (CH)

(72) Inventors: Elmar Taubenrauch, Wurster Nordseeküste (DE); Guido Tants, Midlum (DE)

(73) Assignee: Hunter Douglas Industries Switzerland GmbH, Lucerne (CH)

( * ) Notice: Subject to any disclaimer, the term of this patent is extended or adjusted under 35 U.S.C. 154(b) by 16 days.

(21) Appl. No.: 17/032,856

(22) Filed: Sep. 25, 2020

(65) Prior Publication Data

US 2021/0087880 A1 Mar. 25, 2021

(30) Foreign Application Priority Data

Sep. 25, 2019 (DE) ..... 10 2019 125 865.0

(51) Int. Cl.
*E06B 9/42* (2006.01)
*E06B 9/74* (2006.01)

(52) U.S. Cl.
CPC . *E06B 9/42* (2013.01); *E06B 9/74* (2013.01)

(58) Field of Classification Search
CPC ..... E06B 9/42; E06B 9/74; E06B 9/80; E06B 9/44
USPC ..... 160/309
See application file for complete search history.

(56) References Cited

U.S. PATENT DOCUMENTS

| | | | | |
|---|---|---|---|---|
| 1,321,674 | A | 11/1919 | Sheppard | |
| 4,534,396 | A * | 8/1985 | Jung | E06B 9/90 160/319 |
| 8,739,854 | B2 * | 6/2014 | Mullet | E06B 9/60 160/293.1 |
| 8,776,861 | B2 * | 7/2014 | Bohlen | E06B 9/42 160/310 |
| 9,663,987 | B2 * | 5/2017 | Huang | E06B 9/322 |
| 9,714,539 | B2 * | 7/2017 | Bohlen | E06B 9/78 |
| 10,501,988 | B2 * | 12/2019 | Fisher | E06B 9/84 |
| 2014/0360684 | A1 * | 12/2014 | Bohlen | E06B 9/68 160/310 |
| 2017/0058600 | A1 * | 3/2017 | Mocanu | E06B 9/44 |

FOREIGN PATENT DOCUMENTS

| | | | |
|---|---|---|---|
| CA | 2660914 | A1 | 9/2010 |
| WO | 2010089118 | A1 | 8/2010 |
| WO | 2018049462 | A1 | 3/2018 |

* cited by examiner

*Primary Examiner* — Beth A Stephan
(74) *Attorney, Agent, or Firm* — McGlew and Tuttle, P.C.

(57) ABSTRACT

A roller blind (10) with a curtain that can be wound up on a winding shaft and can be unwound against a spring tension, with a spring (31) for generating the spring tension. The spring (31) is configured such that the curtain remains in each unwound position in a self-retaining manner. A manufacturing effort can be reduced during the assembly by the spring drive being assembled from one or more modularly connected, prefabricated partial springs (31).

22 Claims, 3 Drawing Sheets

ROLLER BLIND, PROCESS FOR MANUFACTURING SAME AND ROLLER BLIND SYSTEM WITH SUCH A ROLLER BLIND

CROSS REFERENCE TO RELATED APPLICATIONS

This application claims the benefit of priority under 35 U.S.C. § 119 of German Application 10 2019 125 865.0, filed Sep. 25, 2019, the entire contents of which are incorporated herein by reference.

TECHNICAL FIELD

The present invention pertains to a roller blind with a curtain, which can be wound up on a winding shaft and can be unwound against a spring tension, with a spring for generating the spring tension, wherein the spring is configured such that the curtain remains in a self-retaining state in each unwound position.

TECHNICAL BACKGROUND

Such a roller blind is known, for example, from the document EP 2 394 014 B1.

It is advantageous in such a self-retaining roller blind that no loops or other loose parts are necessary for the operation. The curtain only needs to be brought directly or by grasping the curtain weight into the desired position, in which the curtain will then remain in a self-retaining manner. This increases child safety because no loop is present, in which children could be strangulated, and there also are no loose parts, which could be swallowed.

The drawback of the prior-art roller blind is the comparatively great effort needed for its manufacture during the assembly of the roller blind. The necessary spring length is calculated and a spring, which is kept in stock in the maximum necessary length, is cut to the calculated size. This leads, in addition, to undesired waste. The complete spring becomes unfit for use and must be replaced in case of an error.

SUMMARY

An object of the present invention is to perfect a roller blind of the type described in the introduction such that assembly is made easier.

The object is accomplished by the spring having one or more modularly prefabricated partial springs in a roller blind of the type mentioned in the introduction.

It was found that an exact adaptation of the spring length is not necessary for the self-retention of the roller blind in the particular position. A certain tolerance can rather be accepted due to the friction in the roller blind or in guide rails, which are possibly present. Due to this modular premanufacture, the desired lengths can be assembled, aside from an acceptable tolerance, simply from the spring lengths that are kept in stock. The assembly is made easier hereby and it is not necessary to throw away the entire spring in case of an error. The spring can rather be simply taken apart again into the partial springs and reassembled. Special manufacturing devices for cutting the springs are not needed.

Another prior-art embodiment of a self-retaining roller blind can be found in WO 2018/049462 A1. However, this prior-art roller blind has a bulky configuration.

A variant of the present invention is characterized in that the partial springs are helically wound torsion springs. This makes possible a simple and space-saving arrangement within the winding shaft. The partial springs preferably have coupling elements at at least one end. This makes it possible to simply combine the partial springs. Hooks, especially preferably U-shaped hooks, may preferably be used as a coupling element. When the torsion springs are extended, they have a certain inherent stiffness and can also be positioned radially as a result. The generation of noise can be reduced thereby. If the partial springs have, in addition, an internal diameter of 19 mm, they can be arranged in common winding shafts in a simple manner.

Another variant of the present invention is characterized in that the partial springs are formed from wire with a thickness of 0.9 mm, 1.0 mm, 1.2 mm and/or 1.5 mm. In particular, the partial springs are prefabricated in a modular manner in the thicknesses mentioned. Springs with different spring force areas can be assembled from the partial springs in this manner. If the partial springs are prefabricated in gradations smaller than or equaling 50 mm, 40 mm, especially preferably 30 mm, especially 25 mm and multiples thereof, it is thus possible to obtain tolerances lower than or equal to 25 mm, 20 mm, 15 mm or 12.5 mm. It was found that these deviations from the exactly needed length still suffice to achieve self-retention of the roller blind curtain in the particular unwound position. If the partial springs are prefabricated in lengths of 200 mm, 100 mm, 50 mm and 25 mm, any desired necessary spring lengths can be manufactured accurately up to a maximum of 12.5 mm.

Yet another variant of the present invention is characterized in that the partial springs or even the corresponding assembled components are color-coded. A simple and less error-prone selection of the necessary partial springs is possible in this manner. The color coding may pertain to both the length of the partial springs and their respective spring wire thickness.

An advantageous embodiment of the present invention is characterized by a coupling piece for coupling to the partial springs. The partial springs can thus be coupled with one another in a simple manner. The coupling piece preferably has at least one coupling projection, especially preferably two coupling projections. A reliable coupling can be achieved in this manner with a simple manufacturing effort. The construction becomes especially simple if the coupling projections are configured as lugs. The coupling projections may be arranged radially and/or axially offset in relation to one another and especially preferably facing one another. The coupling piece can be used in this manner to couple a spring or to connect two springs. This reduces the stocking effort. The coupling piece may also have a centering washer, especially between the coupling projections. This makes it possible to center the coupling piece and hence the spring element within the winding shaft.

Another advantageous embodiment is characterized by at least one fastening piece, which is arranged especially at the end, for interacting with a wall bracket. Simple fastening to the wall can be achieved thereby. Setting devices, especially preferably a secondary drive, for setting the pretension of the spring may especially preferably be associated with the fastening piece. This makes a simple handling possible. It is advantageous now if the setting can be carried out such that, in particular, locking is possible several times, preferably 4 times. The pretension can be set in this manner in a simple manner and yet with sufficient accuracy and lastingly.

In addition, it is advantageous if a roller blind having the features of the present invention has a profiled shaft. The spring can be guided and, when needed, secured against rotation in a simple manner along this profiled shaft. The use of a grooved shaft is especially simple and makes it possible to save material. An aluminum section has a low weight and can be manufactured in a simple manner. Further, it is advantageous if a longitudinal groove is provided. Securing against rotation on the profiled shaft is made especially simple by this. If the profiled shaft is functionally connected to the setting devices, the spring pretension can be set in a simple manner. This is especially true in the case of a functional connection adapted to rotate in unison. The profiled shaft may be connected for this purpose to the setting devices in a positive-locking manner. For connection, the profiled shaft only needs to be inserted into the setting devices. If the profiled shaft is then held in position with a snap ring, secure and firm connection is especially simple.

A variant of the present invention is characterized by a carrier for a partial spring. This makes possible a good coupling of the partial spring. If one end of the carrier is a slide bearing, it can be arranged at this end rotatably, for example, on a hollow shaft. If the other end of the carrier has a functional connection that is especially adapted to rotate in unison and preferably positive-locking to the grooved shaft, force transmission can take place here for pretensioning the spring or the particular spring in case of a plurality of springs. Springs can be connected, for example, in parallel by means of such a carrier.

An advantageous embodiment of the present invention is characterized by a driving head, which is especially arranged adjacent to the fastening piece. A simple drive is obtained here for the winding shaft of the roller blind. The driving head may have a thread, on which a nut, connected to the winding shaft such that it rotates in unison, runs as a stop. This leads to a simple and effective limitation. In addition, at least one partial spring may be functionally connected to the drive in a manner adapted to rotate in unison. The necessary force can be applied with the drive in this way in an especially simple manner. If the partial spring is fastened to the drive, especially by means of at least one coupling piece, simple mounting is possible along with a reliable application of force. In addition, an output at the end of the spring and/or of one of the partial springs, which end faces away from the driving head, is advantageous. The output in the interior of the winding shaft makes possible a simple configuration, especially for the setting devices.

The particular suitable roller blind with self-retaining function can be assembled in a simple manner for any desired and necessary application with a roller blind system with a roller blind according to the present invention and with a number of modularly prefabricated partial springs for the modular assembly of the spring.

Exemplary embodiments of the present invention will be explained in more detail below on the basis of the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
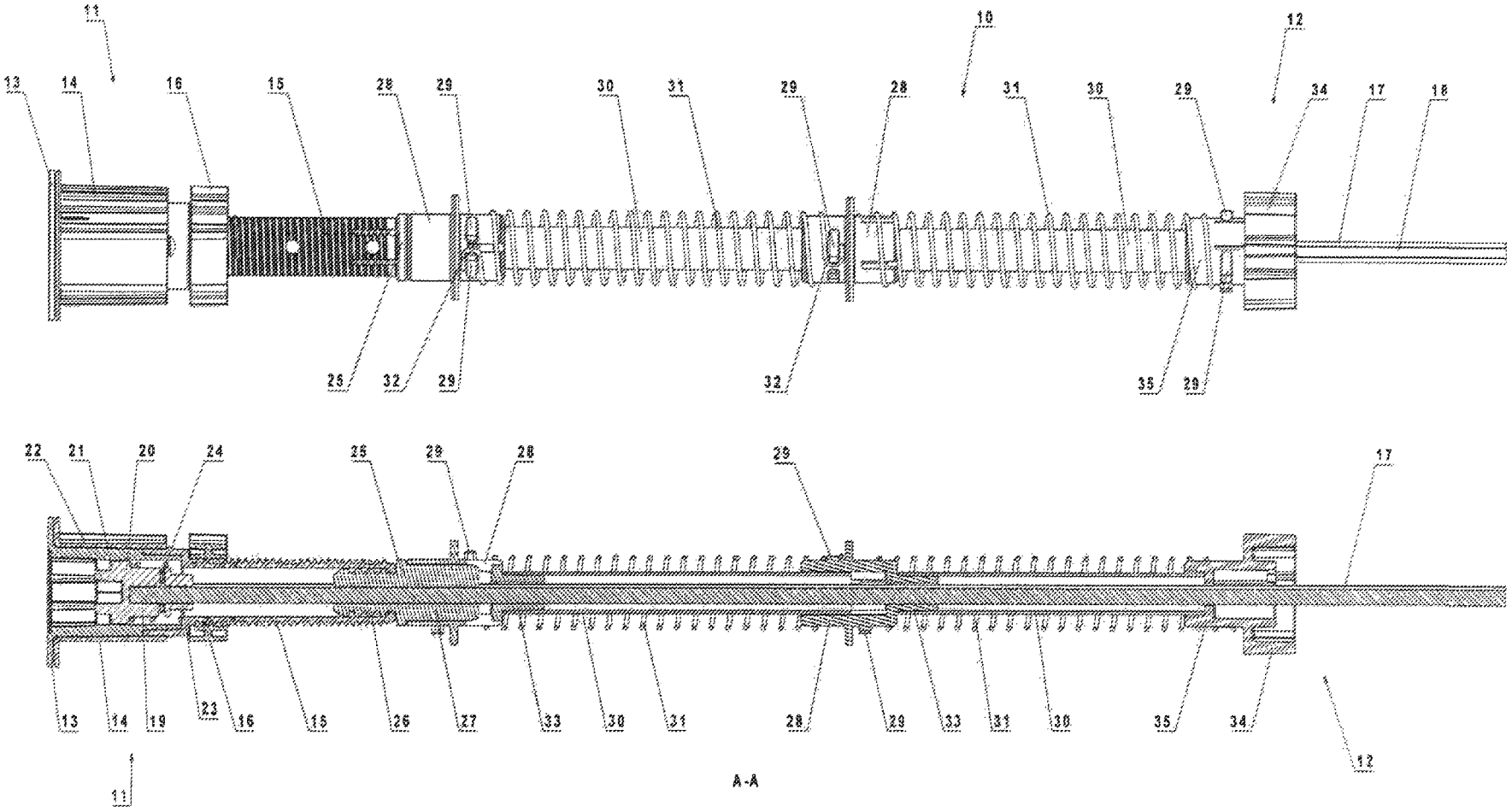
FIG. 1 is a partial view (top) and a cut-away partial view (bottom) of the essential details of a roller blind having the features of the present invention as a first exemplary embodiment.

Referring to the drawings, FIG. 1 shows a partial view (top) and a cut-away partial view (bottom) of the essential details of a roller blind 10 having the features of the present invention as a first exemplary embodiment. The roller blind 10 has a driving head 11 arranged at the left-hand end of the roller blind 10 in the figure and an output 12 arranged farther on the inside of the roller blind 10. The driving head 11 has a fastening piece 13, which interacts in the assembled state with a wall bracket, not shown in the figure.

A shaft adapter 34, on which a winding shaft, not shown in the figure, for a curtain, likewise not shown in the figure, is arranged in a manner adapted to rotate in unison and hence rotatably in relation to the fastening piece 13 on the fastening piece 13 in the assembled state. A threaded section 15 is fastened in a manner adapted to rotate in unison with the fastening piece 13, adjoining the latter axially. A nut 16 is arranged rotatably on the threaded section 15. The external circumference of the nut 16 is connected in the assembled state in a manner adapted to rotate in unison with and axially displaceably to the winding shaft, which is not shown in the figure.

Starting from the driving head 11, a grooved shaft 17 with an elongated groove 18 extends in the interior of the roller blind 10. The longitudinal groove 18 extends in the exemplary embodiment shown over the entire length of the grooved shaft 17. A secondary drive 19 is arranged rotatably about the longitudinal axis in the interior of the fastening piece 13. The secondary drive 19 has an approximately cylindrical shape and has on its outer circumferential surface a plurality of ramps 20, which interact with ramps 21 on the inner circumference of the fastening piece 13. On the end face and facing an open end of the fastening piece 13 for receiving a wall bracket, the secondary drive 19 has a hexagon socket 22. At its end facing away from the hexagon socket 22, the secondary drive 19 has a mount 23 for the grooved shaft 17. Enclosing the outer circumference of the secondary drive 19, a spring 24 is arranged, with which the secondary drive 19 is pretensioned axially away from the threaded section 15 and towards the open end of the fastening piece 13.

A carrier 25, which has, on the whole, a cylindrical configuration and has a first section 26 and a second section 27, is arranged at the end of the threaded section, which end faces away from the secondary drive 19. The grooved shaft 17 extends axially through the carrier 25. The first section 26 is connected in a manner adapted to rotate in unison with the grooved shaft 17, but is mounted rotatably in the threaded section 15.

A spring adapter 28 is connected in a manner adapted to rotate in unison with the second section 27 facing away from the first section 26. The spring adapter 28 has an essentially cylindrical shape. On its outer circumference, the spring adapter 28 has a plurality of projections 29, which are configured as lugs 29. At its end facing away from the carrier 25, the spring adapter 28 has a cylindrical connection piece 33. A hollow shaft 30 is arranged in a manner adapted to rotate in unison on the connection piece 33. Enclosing the hollow shaft 30, a partial spring 31 is arranged, which has respective coupling elements 32 at its ends, which face away from one another. The coupling elements 32 are configured as hooks in the exemplary embodiment shown. The hooks 32 have a U shape and interact with the lug 29 or with the lug 29 of another spring adapter 28 at the end of the partial spring 31, which end faces away from the spring adapter 28.

The additional spring adapter 28 is arranged rotatably on the hollow shaft 30 and is connected with its connection piece 33 in a manner adapted to rotate in unison with another hollow shaft 30. Another spring 31 encloses the additional hollow shaft 30 and is connected with one of its hooks 32 to the lug 29 of the additional spring adapter 28.

A shaft adapter 34, which has, facing the additional spring 31, a connection piece 35, is arranged at the end of the additional spring 31, which end faces away from the additional spring adapter 28. The connection piece 35 likewise has lugs 29. The hook 32 facing away from the additional spring adapter 28 is fastened at the lug 29 of the connection piece 35. The shaft adapter 34 is arranged rotatably on the hollow shaft 30 and on the grooved shaft 17.

Figure 2:
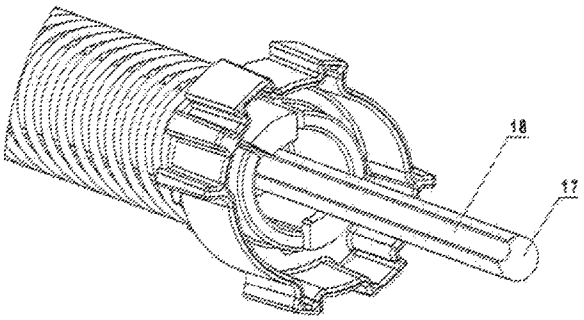
FIG. 2 is a perspective view of a grooved shaft of the roller blind according to FIG. 1.

FIG. 2 shows a perspective view of the grooved shaft 17 of the roller blind 10 according to FIG. 1.

Figure 3:
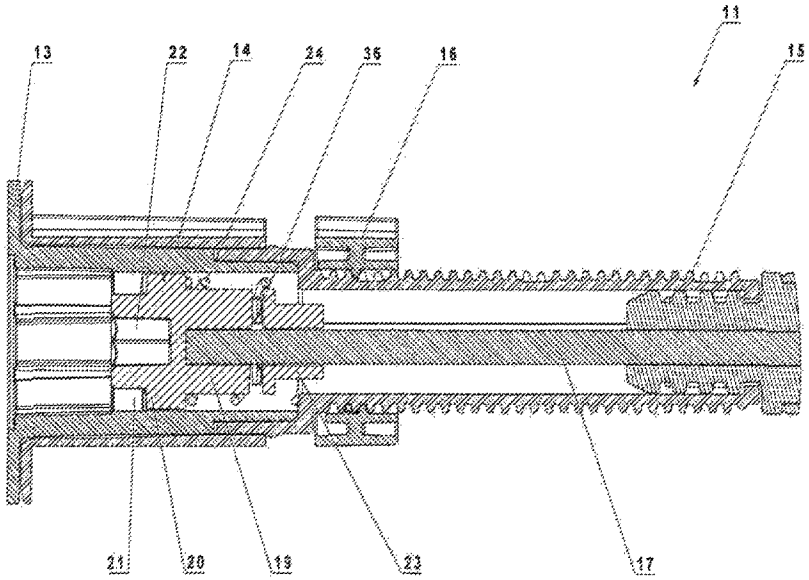
FIG. 3 is a cut-away partial view of a driving head of the roller blind according to FIG. 1.

FIG. 3 shows a cut-away partial view of the driving head 11 of the roller blind 10 according to FIG. 1. As can be seen in the figure, the grooved shaft 17 is secured against pulling out by means of a snap ring 36 in the mount 23.

Figure 4:
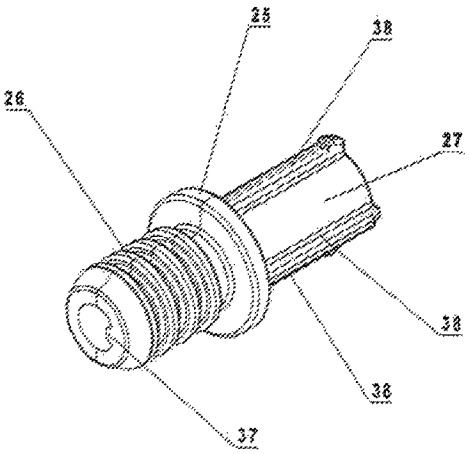
FIG. 4 is a partial view of a carrier of the roller blind according to FIG. 1.

FIG. 4 shows a perspective view of the carrier 25 of the roller blind 10 according to FIG. 1. As can be seen in the figure, a projection is provided in the interior of the first section 26 for interacting with the groove 18 of the grooved shaft 17. The carrier 25 is thus mounted in a manner adapted to rotate in unison on the grooved shaft 17. As can also be seen in the figure, a plurality of ribs 38 are arranged on the outer circumference of the second section. The ribs 38 are used to connect the carrier in a manner adapted to rotate in unison with a spring adapter 28.

The manner of functioning of the roller blind 10 will be explained below on the basis of FIGS. 1 through 4. The desired number of partial springs 31 can be combined by means of the spring adapters 28 to form a spring assembly, an assembled spring. The winding shaft, not shown in the figures, is connected in a manner adapted to rotate in unison with the shaft carrier 14, with the nut 16 and with the shaft adapter 34 in the assembled state. When unwinding the curtain, the spring composed of the partial springs 31 is tensioned. The partial springs 31 are selected to be such that the weight of the curtain and optionally the weight of an additional lower curtain weight are more or less compensated by the spring force in each unwound position. At the same time, the nut 16 turns along the thread of the threaded section 15, to the right in FIG. 1, during the unwinding of the curtain. When the curtain is pushed up, the nut 16 rotates back on the thread of the threaded section 15, to the left in FIG. 1, until the nut 16 strikes the end of the threaded section 15 when reaching the upper end position of the curtain.

To pretension the partial springs, the hexagon socket 22 of the secondary drive 19 can be actuated with an Allen wrench. The ramps 20 are now locked with the ramps 21. Four locking steps are provided per revolution in the exemplary embodiment shown. While the ramps slide along one another, the secondary drive can yield to the right against the action of the spring 24 in FIG. 1 until it snaps back when reaching the next locked position.

Figure 5:
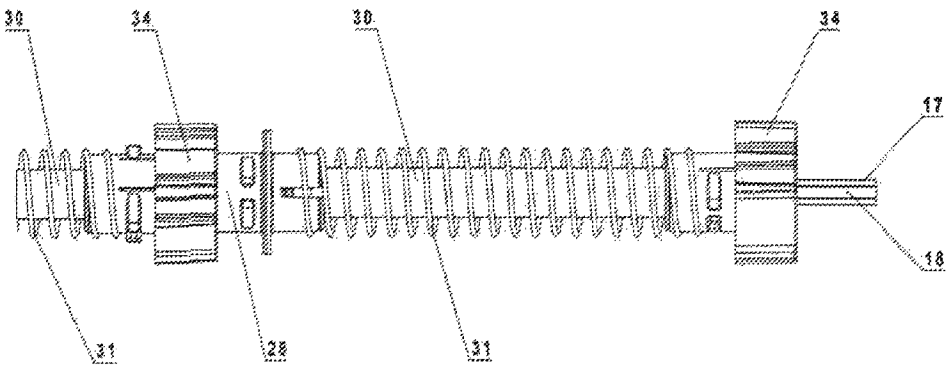
FIG. 5 is a side view of a spring assembly of another exemplary embodiment having the features of the present invention.

FIG. 5 shows a spring assembly of another exemplary embodiment with the features of the present invention. While the partial springs 31 are connected in series in the exemplary embodiment according to FIG. 1, FIG. 5 shows a parallel connection of the partial springs 31. A carrier 25 is arranged for this purpose after the shaft adapter 34, which is on the left in FIG. 5. The carrier 25 is connected rotatably to the shaft adapter 34 but in a manner adapted to rotate in unison with the grooved shaft 17. The projection 37 interacts to this end with the groove 18. When unwinding the curtain from the winding shaft, the two partial springs 31 shown are tensioned each individually between the shaft adapter 34 and the respective corresponding spring adapter 28.

While specific embodiments of the invention have been shown and described in detail to illustrate the application of the principles of the invention, it will be understood that the invention may be embodied otherwise without departing from such principles.

LIST OF REFERENCE NUMBERS

| | |
|---|---|
| 10 | Roller blind |
| 11 | Driving head |
| 12 | Output |
| 13 | Fastening piece |
| 14 | Shaft carrier |
| 15 | Threaded section |
| 16 | Nut |
| 17 | Grooved shaft |
| 18 | Longitudinal groove |
| 19 | Secondary drive |
| 20 | Ramp |
| 21 | Ramp |
| 22 | Hexagon socket |
| 24 | Spring |
| 25 | Carrier |
| 26 | First section |
| 27 | Second section |
| 28 | Spring adapter |
| 29 | Lug |
| 30 | Hollow shaft |
| 31 | Partial spring |
| 32 | Hook |
| 33 | Connection piece |
| 34 | Shaft adapter |
| 35 | Connection piece |
| 36 | Snap ring |
| 37 | Projection |
| 38 | Rib |

What is claimed is:

1. A roller blind with a curtain, which can be wound up on a winding shaft and can be unwound against a spring tension, the roller blind comprising:

a spring for generating the spring tension;

at least one fastening piece configured to interact with a wall bracket;

a setting device associated with the at least one fastening piece, the setting device being configured for setting a pretension of the spring, wherein the setting is carried out such that locking is possible several times;

a snap ring; and a profiled grooved shaft with a longitudinal groove, which is functionally connected with the setting device and adapted to rotate in unison, wherein:

the profiled grooved shaft is held with the snap ring;

the spring is configured such that the curtain remains self-retaining in each unwound position; and the spring comprises one or more modularly prefabricated partial springs, each of the one or more modularly prefabricated partial springs comprising a stock partial spring length.

2. A roller blind in accordance with claim 1, wherein:

the one or more partial springs comprise helically wound torsion springs;

each of the torsion springs comprises a coupling element at at least one end; and the torsion springs are extended and/or have an internal diameter of 19 mm.

3. A roller blind in accordance with claim 1, wherein:

the one or more partial springs are formed from wire with a thickness of one of 0.9 mm, 1.0 mm, 1.2 mm and 1.5 mm;

the one or more partial springs are prefabricated in gradations smaller than or equal to 50 mm and multiples thereof; and the one or more partial springs are prefabricated in a length of one of 200 mm, 100 mm, 50 mm and 25 mm.

4. A roller blind in accordance with claim 1, wherein the one or more partial springs or corresponding assembly components are color-coded.

5. A roller blind in accordance with claim 1, further comprising a coupling piece for coupling to two of the one or more partial springs, the coupling piece having coupling projections configured and arranged radially and/or axially, offset in relation to one another.

6. A roller blind in accordance with claim 1, further comprising a partial spring carrier, the partial spring carrier being configured to cooperate with the one or more partial springs, wherein the partial spring carrier has a slide bearing and/or an end with a functional connection with the profiled grooved shaft and the partial spring carrier is adapted to rotate in unison with the profiled grooved shaft.

7. A roller blind with a curtain, which can be wound up on a winding shaft and can be unwound against a spring tension the roller blind comprising:

a spring for generating the spring tension, the spring being configured such that the curtain remains self-retaining in each unwound position, the spring comprising one or more modularly prefabricated partial springs, each of the one or more modularly prefabricated partial springs comprising a stock partial spring length;

at least one fastening piece configured to interact with a wall bracket;

a setting device associated with the fastening piece, the setting device being configured for setting a pretension of the spring, wherein the setting is carried out such that locking is possible several times; and a driving head arranged adjacent to the fastening piece, wherein the driving head has a thread, on which thread a nut is configured to connect to the winding shaft and configured to rotate in unison therewith.

8. A roller blind in accordance with claim 7, wherein:

the one or more partial springs comprise helically wound torsion springs;

each of the torsion springs comprises a coupling element at at least one end; and the torsion springs are extended and/or have an internal diameter of 19 mm.

9. A roller blind in accordance with claim 7, wherein:

the one or more partial springs are formed from wire with a thickness of one of 0.9 mm, 1.0 mm, 1.2 mm and 1.5 mm;

the one or more partial springs are prefabricated in gradations smaller than or equal to 50 mm and multiples thereof; and the one or more partial springs are prefabricated in a length of one of 200 mm, 100 mm, 50 mm and 25 mm.

10. A roller blind in accordance with claim 7, further comprising:

a snap ring; and a profiled grooved shaft with a longitudinal groove, which is functionally connected with the setting device and adapted to rotate in unison, wherein the profiled grooved shaft is held with the snap ring.

11. A roller blind in accordance with claim 7, wherein:

the driving head is functionally connected with the at least one partial spring to rotate in unison therewith by means of at least one coupling piece and by an output at an end of the spring and/or;

one of the partial springs has an end that faces away from the driving head.

12. A process for manufacturing a roller blind for a curtain, which can be wound up on a winding shaft and can be unwound against a spring tension, the roller blind comprising a spring for generating the spring tension, wherein the spring is configured such that the curtain remains self-retaining in each unwound position, the process comprising the steps of:

providing the spring as one or more modularly prefabricated partial springs; and selecting a number of partial springs from the one or more modularly prefabricated partial springs, each of the one or more modularly prefabricated partial springs comprising a stock partial spring length, wherein:

at least one fastening piece is arranged at an end of the roller blind;

the at least one fastening piece interacts with a wall bracket;

a setting device is associated with the fastening piece for setting a pretension of the spring;

the pretension setting is carried out such that locking is possible several times;

a profiled grooved shaft with a longitudinal groove is functionally connected with the setting device so as to rotate in unison therewith; and the profiled grooved shaft is held to the setting device with a snap ring.

13. A process in accordance with claim 12, wherein the one or more modularly prefabricated partial springs comprise helically wound torsion springs with a coupling element at at least one end, wherein the torsion springs are extended and/or have an internal diameter of 19 mm.

14. A process in accordance with claim 12, wherein:

the one or more partial springs are made of wire with a thickness of one of 0.9 mm, 1.0 mm, 1.2 mm and 1.5 mm;

the one or more partial springs are modularly prefabricated in said thicknesses;

the one or more partial springs are prefabricated in gradations smaller than or equal to 50 mm and multiples thereof; and the one or more partial springs are prefabricated in lengths of 200 mm, 100 mm, 50 mm, and 25 mm.

15. A process in accordance with claim 12, wherein:

the one or more partial springs are color-coded partial springs; and/or color-coded assembled components are used.

16. A process in accordance with claim 12, wherein:

a coupling piece is used for coupling to the one or more partial springs;

the coupling piece has at least one coupling projection; and the coupling piece has a centering washer.

17. A process in accordance with claim 12, wherein a carrier with a slide bearing and/or an end having a functional connection with a grooved shaft and adapted to rotate in unison with the grooved shaft is used for carrying the partial spring.

18. A process for manufacturing a roller blind for a curtain, which can be wound up on a winding shaft and can be unwound against a spring tension, the roller blind comprising a spring for generating the spring tension, wherein the spring is configured such that the curtain remains self-retaining in each unwound position, the process comprising the steps of:

providing the spring as one or more modularly prefabricated partial springs; and selecting a number of partial springs from the one or more modularly prefabricated partial springs, each of the one or more modularly prefabricated partial springs comprising a stock partial spring length, wherein a driving head is arranged adjacent to a fastening piece, wherein the driving head has a thread, on which thread a nut is configured to connect to the winding shaft and configured to rotate in unison therewith.

19. A process in accordance with claim 18, wherein:

at least one fastening piece is arranged at an end of the roller blind;

the at least one fastening piece interacts with a wall bracket;

a setting device is associated with the fastening piece for setting a pretension of the spring; and the pretension setting is carried out such that locking is possible several times.

20. A process in accordance with claim 18, wherein:

a profiled grooved shaft with a longitudinal groove is functionally connected with a setting device so as to rotate in unison therewith; and the profiled grooved shaft is held to the setting device with a snap ring.

21. A process in accordance with claim 18, wherein a carrier with a slide bearing and/or an end having a functional connection with a grooved shaft and adapted to rotate in unison with the grooved shaft is used for carrying the partial spring.

22. A process in accordance with claim 18, wherein:

the driving head is functionally connected with the at least one partial spring to rotate in unison therewith by means of at least one coupling piece and by an output at an end of the spring and/or;

one of the partial springs has an end that faces away from the driving head.

* * * * *